US009611677B2

(12) United States Patent
Bendel et al.

(10) Patent No.: US 9,611,677 B2
(45) Date of Patent: Apr. 4, 2017

(54) LOCK FOR A FLAP OR DOOR

(75) Inventors: Thorsten Bendel, Oberhausen (DE); Serkan Gülkan, Hattingen (DE); Karsten Barth, Hattingen (DE); Dusan Petrus, Pardubice (CZ)

(73) Assignee: Kiekert Aktiengsellschaft, Heiligenhaus (DE)

( * ) Notice: Subject to any disclaimer, the term of this patent is extended or adjusted under 35 U.S.C. 154(b) by 375 days.

(21) Appl. No.: 13/985,598

(22) PCT Filed: Jan. 19, 2012

(86) PCT No.: PCT/DE2012/000047

§ 371 (c)(1),
(2), (4) Date: Mar. 27, 2014

(87) PCT Pub. No.: WO2012/110014

PCT Pub. Date: Aug. 23, 2012

(65) Prior Publication Data

US 2014/0217753 A1 Aug. 7, 2014

(30) Foreign Application Priority Data

Feb. 15, 2011 (DE) ..... 20 2011 000 341 U

(51) Int. Cl.
*E05C 3/16* (2006.01)
*E05B 79/16* (2014.01)
(Continued)

(52) U.S. Cl.
CPC ..... *E05B 79/16* (2013.01); *E05B 15/04* (2013.01); *E05B 79/08* (2013.01); *E05B 85/02* (2013.01);
(Continued)

(58) Field of Classification Search
CPC ..... E05B 79/08; E05B 79/16; E05B 15/04; E05B 85/02; E05B 85/26;
(Continued)

(56) References Cited

U.S. PATENT DOCUMENTS 3,334,934 A * 8/1967 Sandor ..... E05B 85/243 292/216
3,876,238 A * 4/1975 Watermann ..... E05B 77/38 292/216
(Continued)

FOREIGN PATENT DOCUMENTS

DE WO 2005068754 A1 * 7/2005 ..... E05B 85/02

OTHER PUBLICATIONS

International Search Report with Written Opinion for corresponding patent application No. PCT/DE2012/000047 dated Sep. 14, 2012.

*Primary Examiner* — Alyson M Merlino
(74) *Attorney, Agent, or Firm* — Renner, Otto, Boisselle & Sklar, LLP

(57) ABSTRACT

The invention relates to a lock for a flap or a door, with a lock housing, a locking mechanism consisting of a rotary latch (4) and at least one pawl (6), and at least one spring (23) which is capable of pivoting a pivotable component of the lock from a starting position in the direction of an end position by means of spring force, characterized in that the spring (23) is held by a bearing stud (22) which is connected integrally to the lock housing (25) of the lock, and wherein the bearing stud has a stop (24) for the spring, and/or wherein the bearing stud (22) is connected integrally to the stop (24), wherein the stop (24) has the effect that the pivotable component is not spring-loaded in the end position thereof.

8 Claims, 6 Drawing Sheets

(51) Int. Cl.
*E05B 15/04* (2006.01)
*E05B 85/02* (2014.01)
*E05B 85/26* (2014.01)
*E05B 79/08* (2014.01)

(52) U.S. Cl.
CPC ..... *E05B 85/26* (2013.01); *E05B 2015/041* (2013.01); *E05B 2015/0437* (2013.01); *Y10T 292/1055* (2015.04)

(58) Field of Classification Search
CPC ..... E05B 2015/0403; E05B 2015/041; E05B 2015/042; E05B 2015/0437; E05B 2015/0441
USPC ..... 292/201, 216, 198, 194, DIG. 23, 292/DIG. 61, DIG. 38, DIG. 51, DIG. 53, 292/DIG. 64
See application file for complete search history.

(56) References Cited

U.S. PATENT DOCUMENTS 4,538,845 A * 9/1985 Yamada ..... E05B 85/02 292/216
4,775,176 A * 10/1988 Ikeda ..... E05B 85/243 292/216
4,971,373 A 11/1990 Hamada et al.
5,181,754 A * 1/1993 Shibata ..... E05B 85/243 292/216
5,328,219 A * 7/1994 Konchan ..... E05B 85/243 292/1
5,505,506 A * 4/1996 Kleefeldt ..... E05B 77/34 292/216
5,961,164 A * 10/1999 Gomi ..... E05B 85/243 292/216
5,979,951 A * 11/1999 Shimura ..... E05B 85/26 292/216
6,059,328 A * 5/2000 Gomi ..... E05B 77/34 292/216
6,581,987 B1 * 6/2003 Wortmann ..... E05B 83/24 292/216
7,927,535 B2 * 4/2011 Cetnar ..... E05B 85/02 264/255
2001/0024040 A1 * 9/2001 Spurr ..... E05B 85/243 292/216
2005/0173933 A1 * 8/2005 Cetnar ..... E05B 17/0012 292/216
2010/0127512 A1 * 5/2010 Vazquez ..... E05B 85/26 292/216
2011/0012376 A1 1/2011 Hunt et al.
2012/0068480 A1 * 3/2012 Bendel ..... E05B 85/26 292/220

* cited by examiner

LOCK FOR A FLAP OR DOOR

FIELD OF THE INVENTION

The invention relates to a lock for a flap or a door. The door or flap can be a door or flap of a motor vehicle or of a building.

BACKGROUND OF THE INVENTION

The aforementioned lock contains a locking mechanism with a rotary latch and at least a pawl with which the rotary latch can be latched in the closed position. The locking mechanism is mounted on a lock plate, generally made of metal or a lock case generally made of metal. Generally, such a lock also contains a lock housing, which is generally made of plastic and which can protect components of the lock against external influences. Furthermore, the arrangement can contain a lock cover, made in particular of plastic and/or a cover for a central locking, made in particular of plastic and that also provides protection.

The invention relates, in particular to a lock with a pawl for the main locking position of the rotary latch (hereinafter referred to as "main locking pawl"), a pawl for the intermediate locking position of the rotary latch (hereinafter referred to as "intermediate locking pawl") and a blocking lever for the said main locking pawl. Such a lock is known from printed publication DE 10 2007 003 948 A1.

The rotary latch of the motor vehicle lock known from DE 10 2007 003 948 A1 contains a fork-like intake slot into which a locking bolt of a motor vehicle door or of a motor vehicle flap is moved when the motor vehicle door or motor vehicle flap is closed. The locking bolt pivots the rotary latch in this case from an open position to a closed position. Once the rotary latch has reached a closed position, the locking bolt can no longer leave the intake slot of the rotary latch. In the closed position the pawl latches the rotary latch so that it can no longer be turned back into the open position. The lock is then in a latched arrangement or position.

The lock disclosed in DE 10 2007 003 948 A1 contains two detent positions, that can be assumed in succession by the rotary latch during closing, i.e. the so-called intermediate locking position of the rotary latch and the so-called main locking position of the rotary latch.

In order to avoid that a pawl is inadvertendly moved out of its detent position, a blocking lever can be provided that blocks such a movement when the rotary latch is latched. In the lock disclosed in printed publication DE 10 2007 003 948 A1, such a blocking lever is required for the main locking pawl, as the rotary latch and the main locking pawl are designed in such a way that the rotary latch can introduce an opening moment in the main locking pawl in the main locking position.

The above characteristics, already known from prior art, can be individually or in any combination combined with the object of the present invention.

A lock of the aforementioned type thus has components such as a pawl, blocking lever or rotary latch that can and should be pivoted. Regularly such arrangements also include at least one pretensioned spring producing such a desired pivoting movement of such a component by a spring force. Such a pretensioned spring can, for instance, move a pawl into its detent position, move a blocking lever into its blocking position or a rotary latch into its open position. DE 10 2007 003 948 A1 discloses a spring-loaded rotary latch, i.e. a rotary latch, which can be pivoted by the spring force of the respective spring.

SUMMARY OF THE INVENTION

It is the task of the invention to further develop a lock of the aforementioned type.

To solve this task, the invention provides a lock for a door or flap with a locking mechanism consisting of a rotary latch and at least a pawl and a spring. The spring can move a pivotable component of the lock by means of the spring force from an initial position in the direction of an end position. The spring, in particular, a leg spring is held by a bearing mandrill connected to the lock housing of the lock to form a single piece. In this embodiment no separate mandrill has to be rivetted by which the spring is being held. In particular, the bearing mandrill for the spring is simply produced together with the lock housing by injection moulding and is generally made of plastic. In addition, the arrangement includes a stop for a spring connected to the lock housing and the bearing mandrill to form a single piece, ensuring that the pivotable component is not spring loaded in its end position. In the end position no spring force of the spring is, however, exerted on the pivotable component. The pivotable component thus enters the end position without the pressure of the spring. This results in a considerable noise reduction compared to the case where the spring acts onto the pivotable component up into the end position. The stop is therefore also produced, in particular, by injection moulding together with the lock housing and is generally made of plastic.

The stop ensures that in the end position and preferably shortly before this position is reached, no spring force of the spring is acting on the pivotable component. In this embodiment, the spring can be pretensioned in any manner. The pretensioning of the spring can thus be selected in such a way that the pivotable component is pivoted at a desired speed and/or with a sufficient force. The stop also ensures that no spring force is acting on the pivotable component in the end position. The pivotable component is thus certainly not spring loaded in the end position, even if the spring is subjected to relative considerable pretensioning, for instance in the initial position.

In one embodiment of the invention the arrangement is a leg spring. Preferably, the lock housing contains at least two stops for the legs of the leg spring. The stops are then also connected to the lock housing to form a single piece and are again, in particular, made by injection moulding and generally from plastic. The single-piece production reduces the number of parts that have to be produced.

In one embodiment of the invention, the said stops are a side wall of the lock housing extending, in particular, parallel to the bearing mandrill. Preferably, the side wall contains a projection, which is, in particular triangular. The bottom of the projection then preferably extends at least essentially vertically to the side wall, on which the projection is mounted. The bottom of the projection thus forms in the embodiment a right angle with the side wall. In the assembled state of the spring, a leg of the spring abuts against this bottom side and is held by the projection, i.e. in the installation position, when the spring has been installed. The top of the projection extending diagonally downwards relative to the side wall then functions as a ramp, allowing the leg of the spring to be easily arranged in the correct installation position by simply pushing it down during assembly.

Another stop for a leg of the spring can be connected to the lock housing to form a single piece, irrespective of the spring leg. This stop extends, in particular, parallel to the bearing mandrill of the spring. Preferably it contains a cantilever arm serving as a guide of the respective leg of the leg spring. The leg of the leg spring then abuts this guide. This leg pivots at a certain time during the operation of the lock, in order to move a spring-loaded pivotable component from a starting position into an end position.

All in all, this embodiment allows installation of the spring before the lock housing is placed on the lock plate together with the spring or is inserted in a lock case of the lock. The lock plate or the lock case are generally made of metal. The locking mechanism is pivotably mounted on the lock plate or the lock case. This embodiment provides for a particularly simple installation.

The spring loading of the pivotable component ends preferably shortly before reaching the end position. It is thus particularly reliably ensured that the pivotable component reaches its end position. This means that as soon as the pivotable component reaches a position at which it is no longer spring loaded, it only has to be turned by several degrees to reach the end position. In this case, the component has, in particular, only to move a small distance without the support of the spring force. In one embodiment, the component does then not have to be moved more than 5° or preferably more than 3° or particularly preferably more than 1°, to reach the end position with any spring force being applied.

The pivotable component can be a pawl and/or a blocking lever. The respective component is then spring loaded in the initial position but not in the end position. In the end position the spring force does thus not act on the pivotable component. Where the pivotable component is a pawl, the opening forces required to move the pawl out of its detent position are reduced. Apart from a considerable noise reduction this case thus produces another advantage.

Below, a preferred embodiment of the invention, shown in the figures, is explained in detail. With the aid of the example embodiment, advantages of other embodiments of the invention are disclosed.

In which:

DETAILED DESCRIPTION OF THE INVENTION

Figure 1:
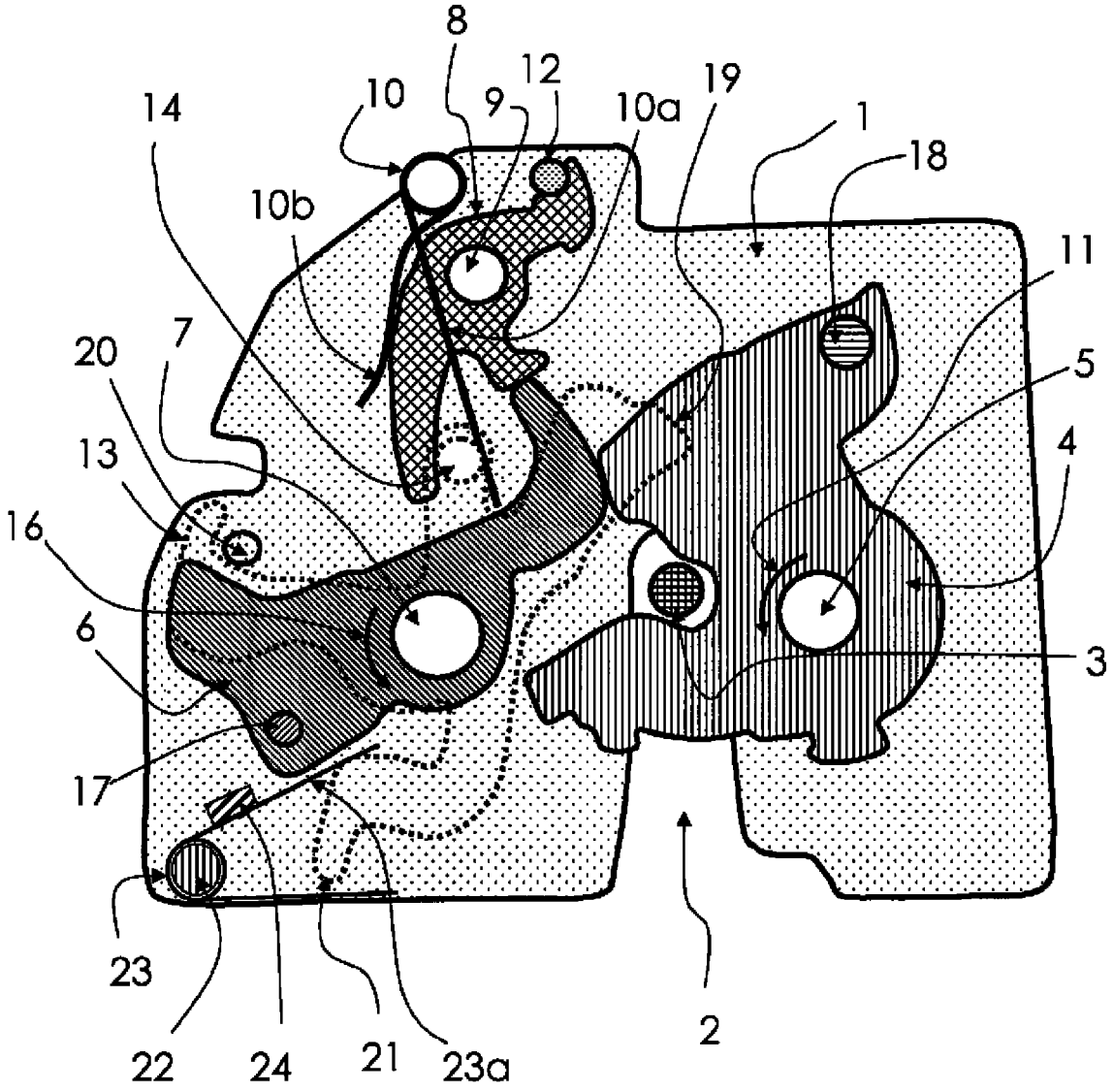
FIG. 1: shows a locking mechanism in the main locking position of the rotary latch

FIG. 1 shows a top view onto a wall 1 of a motor vehicle lock. The wall 1 can be a lock plate or part of a lock case. The wall 1 is preferably made of metal. The wall 1 contains an intake slot 2, into which a locking bolt 3 of a motor vehicle door or of a motor vehicle flap is moved when the respective motor vehicle door or motor vehicle flap is closed. A rotary latch 4 is pivotably mounted on the wall 1 and can be turned around its fixing axis 5. FIG. 1 shows the main locking position of the rotary latch in which the locking bolt 3 in the wall intake slot 2 is enclosed by the intake slot of the rotary latch in such a way that the locking bolt 3 can no longer be moved out of the wall intake slot 2. The respective door or flap of the motor vehicle is then closed as a result of the latching of the pawl in the main locking position of the rotary latch. The figure shows the main locking position, as the pivotably mounted main locking pawl 6 stops, as shown, the rotary latch from being turned back in the shown direction of the arrow 11 into the open position. The main locking pawl 6 is also mounted on the wall 1 and can be pivoted around its fixing axis 7. The rotary latch is preferably pretensioned in the direction of the open position by the spring not shown in FIG. 1. As a result of this pretensioning, the rotary latch presses against a stop of the main locking pawl that is sloped. This slope pushes the main locking pawl 6 out of the detent position. An opening moment is thus introduced into the main locking pawl 6.

If the rotary latch 4 is not pretensioned by a spring, at least the locking bolt 3 produces a pivoting movement of the rotary latch 4 in the direction of the open position as indicated by arrow 11, when a respective motor vehicle door or a motor vehicle flap is opened. The resulting torque then pushes the main locking pawl 6 out of the detent position.

In the main locking position of the rotary latch with the motor vehicle door or motor vehicle flap closed, this is however, prevented by a pivotably mounted blocking lever 8, as shown. The blocking lever 8 is also pivotably mounted on the wall 1 and can be pivoted around its fixing axis 9. An arm 10*b* of a spring 10 rests against a lateral contour area of the blocking lever 8. The spring 10 is pretensioned in such a way that the arm 10*b* of the spring 10 pushes the blocking lever 8 in the direction of the shown blocking position. The resulting pivoting movement of the blocking lever is restricted, as shown, by a stop 12, mounted on the wall 1 as a protruding bolt.

In the embodiment shown in FIG. 1, a pivotable intermediate locking pawl 13, shown transparently in order to offer a view of the components situated underneath it, is arranged above the main locking pawl 6. The intermediate locking pawl 13 is also rotatably mounted on the axis 7 and can thus be turned around this axis 7. The outline of the intermediate locking pawl 13 is indicated by the dots. The intermediate locking pawl 13 contains a bolt 14 also shown transparently in FIG. 1, extending from the intermediate locking pawl 13 downwards in the direction of wall 1. The other arm 10*a* of the spring 10 rests against this bolt 14 which is mounted on the intermediate locking pawl. In the main locking position of the rotary latch, the bolt 14 also rests against a lateral contour area of the blocking lever 8. If the intermediate locking pawl 13 is turned in the direction of the arrow 16 by actuating the lever arm 21, the bolt 14 causes the blocking lever 8 to be moved out of the blocking position. If the blocking lever 8 is moved out of the blocking position in this way, the main locking pawl 6 is pushed out of its shown detent position by the rotary latch 4. Also or alternatively, a lateral contour area of the intermediate locking pawl 13 engages, as a result of the pivoting movement, with a protruding bolt 17 mounted on the main locking pawl 6 and serving as a stop. As a result, the main locking pawl 6 is pivoted out of the detent position and releases the rotary latch. This then pivots, as shown by the arrow 11, in the direction of the open position and finally releases the locking bolt 3. The respective door or flap can then be opened.

The intermediate locking pawl 13 can also latch the rotary latch 4 when a protruding bolt 18 of the rotary latch 2 makes contact with the lateral blocking surface 19 of the intermediate locking pawl 13 and thus prevents pivoting of the pawl in the direction of the open position as indicated by arrow 11. Preferably, the intermediate locking pawl 13 is pretensioned by a spring, not shown, in the direction of the detent position and is spring-loaded like the blocking lever. A protruding bolt 20 mounted on the wall 1 and used as a stop, prevents further turning of the intermediate locking pawl past the detent position.

The lock according to FIG. 1 includes a pretensioned spring 23 with a main locking pawl 6 that can be moved from its non-latched position, i.e. from its initial position, to its end position, i.e. in the direction of the detent position shown in FIG. 1. The main locking pawl 6 is in the detent position shown in FIG. 1, i.e. in its end position but is still not spring loaded, as this is prevented by stop 24 for the spring arm 23*a* of the spring 23. The spring 23, the stop 24 and a stop for the other arm of the spring 23 are preferably mounted on a lock housing made, in particular, of plastic and which is not shown in FIG. 1, as this would impair the view on the other shown components.

The invention also includes the case that the pivotable component, which is not spring-loaded in its end position, i.e. in this case the main locking pawl 6 can also be pivoted by other components. In this case, such additional pivoting can, for instance, be supported by a pivoting movement of the blocking lever 8 into the blocking position. Such additional pivoting is, however, not absolutely mandatory. The kinetic energy generated by pivoting with the aid of the spring force, regularly suffices for moving the pivotable component up to its end position, although the pivotable component is no longer spring loaded in its end position. The spring 23 is preferably retained by a mandrill 22 which is part of a lock housing made of plastic, i.e. which has been produced as a single piece with the lock housing.

Figure 2:
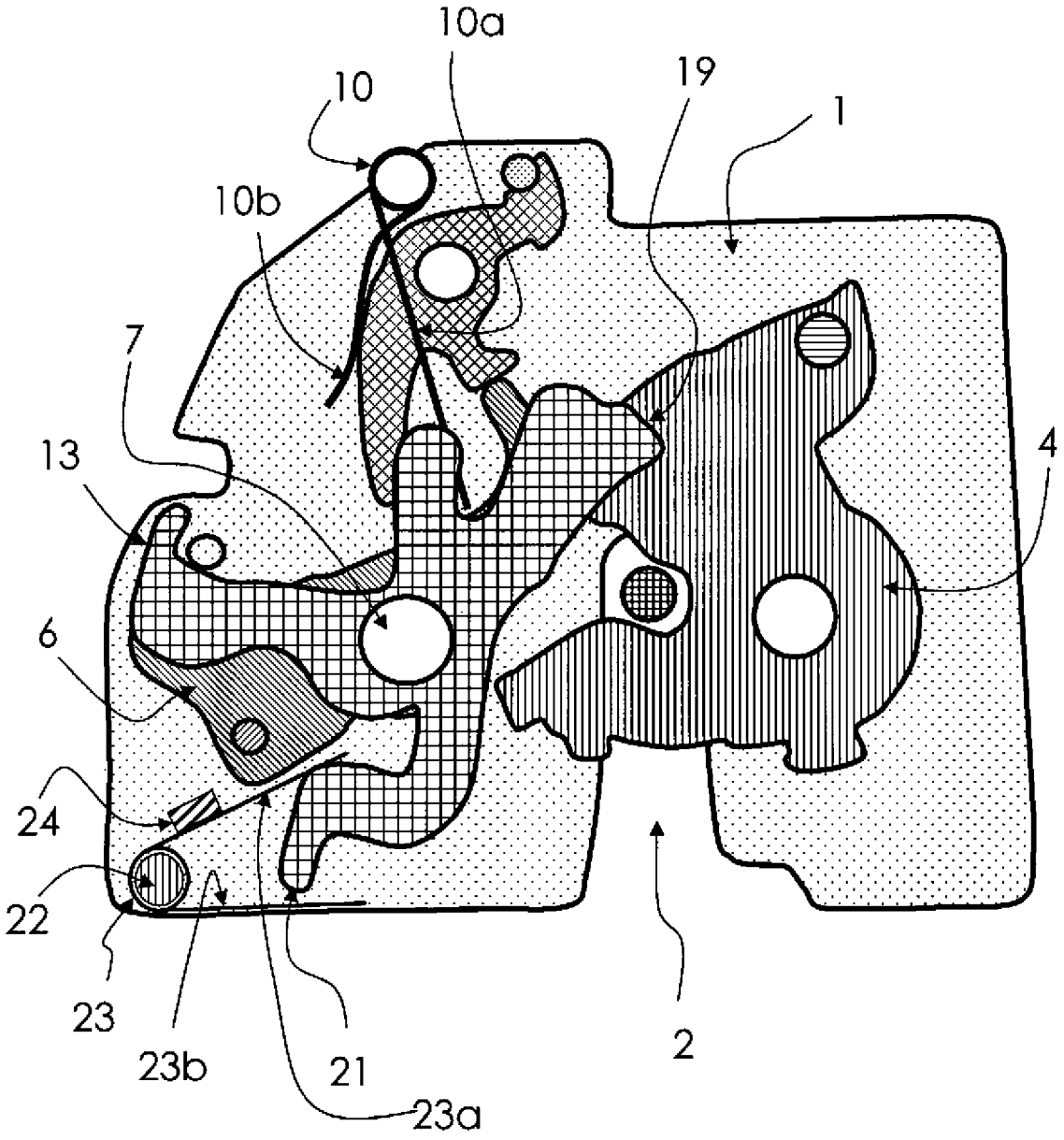
FIG. 2: shows a locking mechanism in the main locking position of the rotary latch

FIG. 2 shows the lock of FIG. 1. The intermediate locking pawl 13 is, however, not transparent in this figure. It therefore partially covers the main locking pawl 13 as well as some of the spring arm 23*a* of the spring 23.

Figure 3:
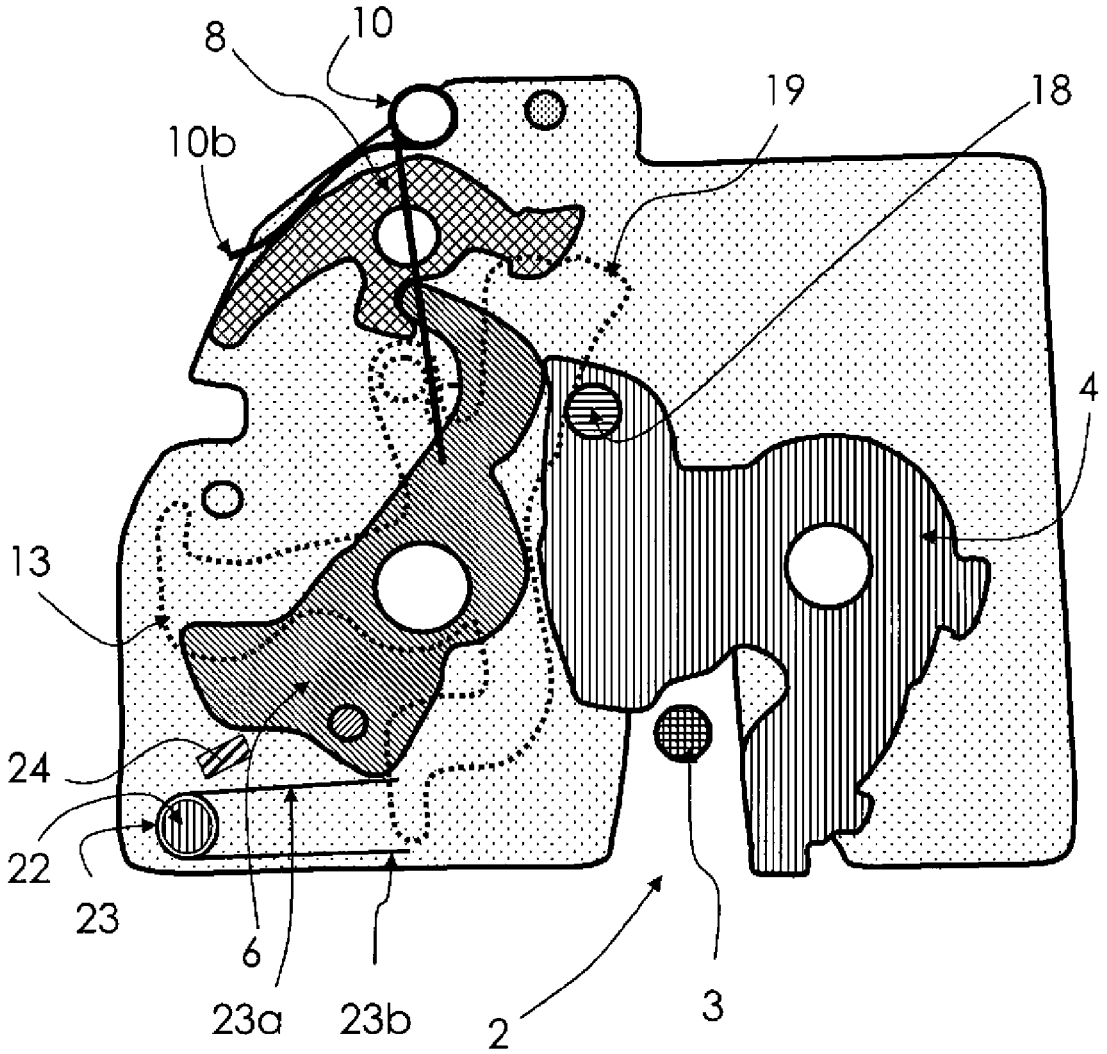
FIG. 3: shows a locking mechanism in the opened position

FIG. 3 shows the position of the rotary latch 4, the main locking pawl 6, the blocking lever 8, the spring 23, the spring 10 and the locking bolt 3 in the open position. Also, the position of the intermediate locking pawl 13 is indicated as a transparent transparently shown area. The locking bolt 3 can now be moved out of the intake slot 2 and the respective door or flap can be opened. The spring arm 23*a* has now been moved away from stop 24 in the direction of the other spring arm 23*b* by the pivoting of the main locking/pawl 6. As a result, the pretensioning of the spring 23 has been increased. In this initial position, the spring 23 can turn the main locking pawl 6 in the direction of the detent position by means of the spring force. In the open position shown in FIG. 3, the main locking pawl 6 is this spring-loaded by the spring 23.

Figure 4:
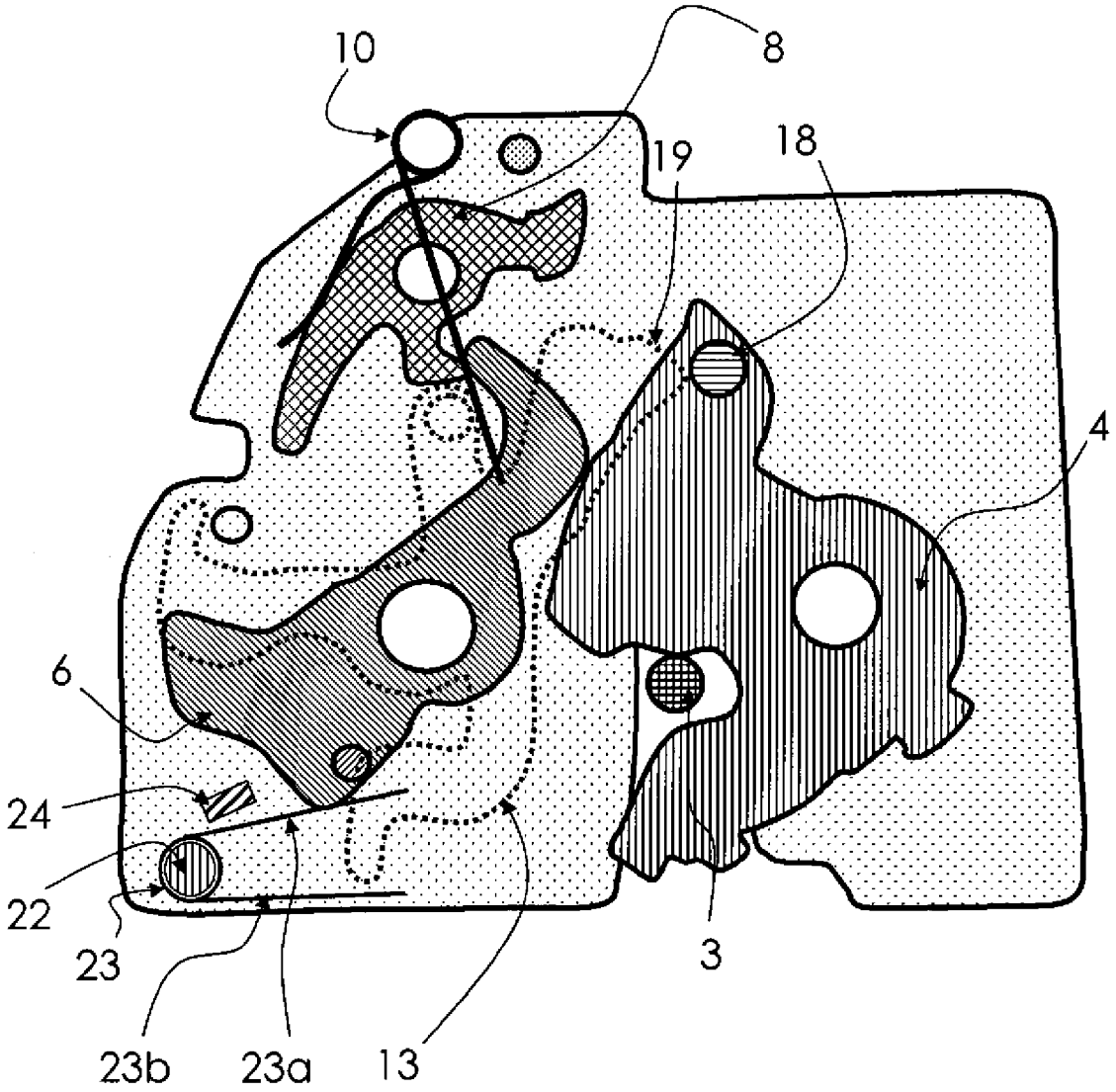
FIG. 4: shows a locking mechanism in an intermediate position

FIG. 4 shows an intermediate position between the open position and the main locking position of the rotary latch 4. If the rotary latch 4 is turned further in the direction of the main locking position by the bolt 3, the transparently shown intermediate locking pawl 13 can first of all engage in its detent position. In this intermediate position shown in FIG. 4, the main locking pawl 6 is still spring-loaded by the spring 23.

Preferably the main locking pawl 6 is still spring-loaded once the intermediate locking position has been reached. If the rotary latch 4 is moved from the Intermediate locking position to the main locking position, this spring-loading suffices for moving the main locking pawl 6 into its detent position.

Figure 5:
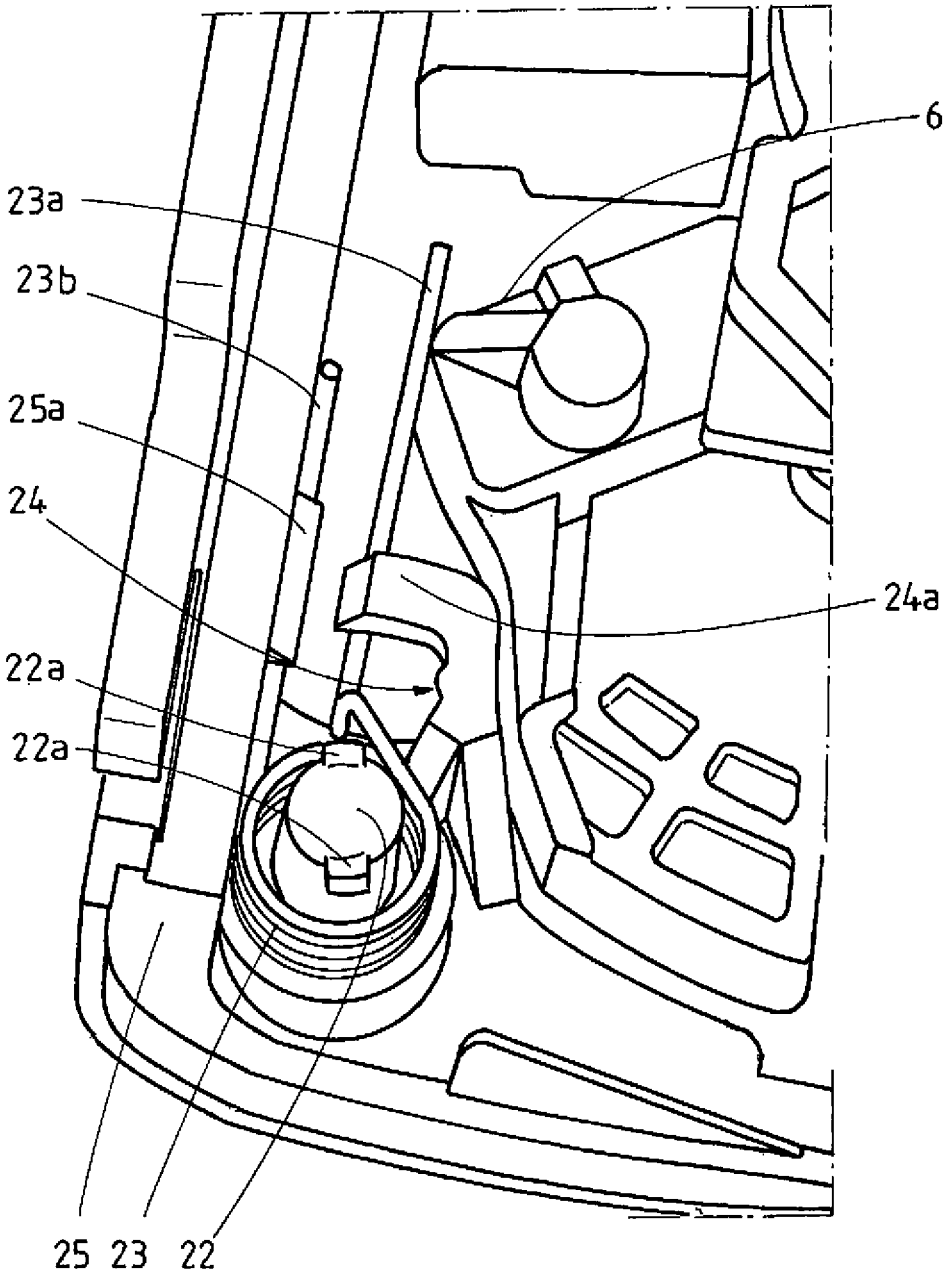
FIG. 5: shows a section in opened position

FIG. 5 shows a section of an enlarged view of the lock in the open position and, in contrast to the previous figures, viewed from the lock plate or the lock case of the lock. FIG. 5 shows that the bearing mandrill 22 is connected to the lock housing 25 to form a single piece. The bearing mandrill 22 contains two protruding lugs 22*a*, preventing the spring 23 from slipping out of the bearing mandrill 22. The protruding lugs 22*a* have such a ramp shape that the spring 23 can assume the shown installed position by applying it and pushing. A lateral wall of the lock housing 25 contains a projection 25*a* contributing to the spring am 23 of the spring 23 is held in the desired location. The respective lateral wall also serves as a stop for the spring arm 23*b*, so that it remains permanently in the shown position. The stop 24 contains a cantilever arm 24*a*, which when viewed from the lock case or the lock housing is always above the spring arm 23*a*. The cantilever arm 24*a* also ensures that the spring arm 23*a* is held at the desired level. The pretensioned arm 23*a* of the spring 23 rests against the main locking pawl 6. The main locking pawl 6 is therefore spring loaded in this initial position.

Figure 6:
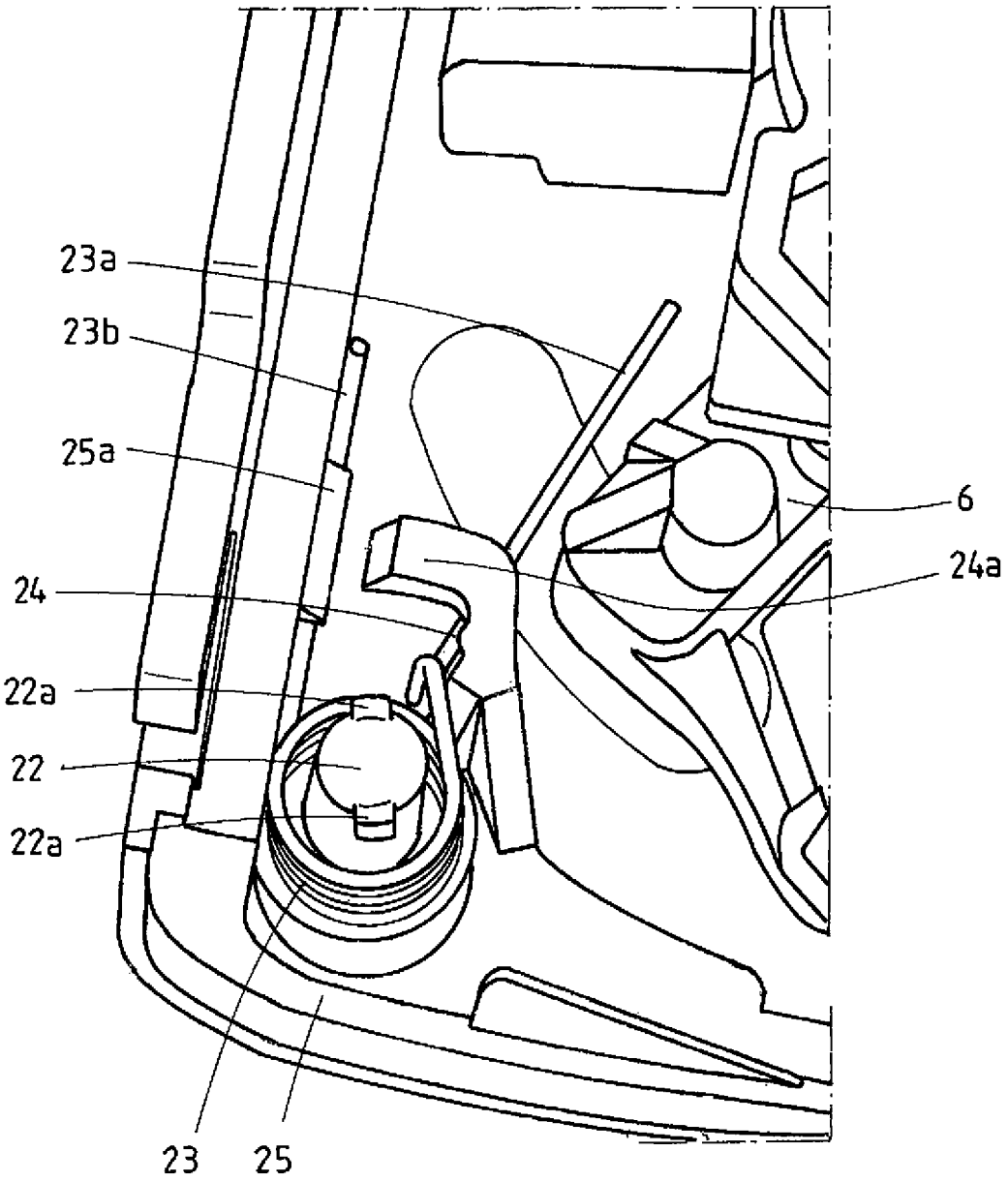
FIG. 6: shows a section in the main locking position of the rotary latch

FIG. 6 shows the section of FIG. 5 in the main locking position of the rotary latch. The spring arm 23*a* rests against the stop 24 without touching the main locking pawl 6. In the main locking position of the rotary latch, the main locking pawl 6 is therefore no longer spring loaded.

LIST OF REFERENCE NUMBERS

1: Wall of a lock plate or of a lock case
2: Intake slot
3: Locking bolt
4: Rotary latch
5: Fixing axis
6: Main locking pawl
7: Fixing axis
8: Blocking lever
9: Fixing axis
10: Spring
10*b*: Spring arm
10*b*: Spring arm
11: Opening direction
12: Stop
13: Intermediate locking pawl
14: Bolt
16: Direction of rotation
17: Bolt
18: Bolt
19: Blocking surface of intermediate locking pawl
21: Lever arm of intermediate locking pawl
20: Bolt
22: Mandrill
22*a*: Lug
23: Pretensioned spring
23*a*: Spring arm
23*b*: Spring arm
24: Stop
24*a*: Cantilever arm
25: Lock housing
25*a*: Projection

The invention claimed is:

1. A lock for a door or flap comprising:

a lock housing, a locking mechanism including a rotary latch and a main locking pawl, wherein the main locking pawl is pivotable between an initial position in which the rotary latch is open and an end position in which the rotary latch is locked, and a spring able to pivot the main locking pawl of the locking mechanism by means of spring force from the initial position in a direction of the end position, wherein the lock has a bearing mandrill and a stop for the spring, the stop and the bearing mandrill being formed with the lock housing as a single piece of common material, and the spring is held by the bearing mandrill connected to the lock housing, and the stop for the spring ensures that in the end position no spring force acts on the main locking pawl, and in the initial position the spring is disengaged from contact with the stop;

wherein the locking mechanism further includes an intermediate locking pawl having a surface that presses against the rotary latch in an intermediate locking position when the main locking pawl is in an intermediate position between the initial position and the end position, and the spring force of the spring acts on the main locking pawl when the rotary latch is in the intermediate locking position; and wherein the intermediate locking pawl and the main locking pawl rotate about a common axis of rotation.

2. The lock according to claim 1, wherein the spring is a leg spring and a first leg of the leg spring interacts against the stop ensuring that in the end position no spring force acts on the main locking pawl.

3. The lock according to claim 1, wherein the lock housing is made of plastic.

4. The lock according to claim 1, wherein the lock housing is arranged on a lock plate made of metal or in a lock case made of metal.

5. The lock according to claim 1, wherein the rotary latch can initiate an opening moment onto the main locking pawl in a main locking position of the rotary latch corresponding to the end position of the main locking pawl in which the rotary latch is locked.

6. The lock according to claim 2, further comprising a further stop that is a side wall of the lock housing extending parallel to the bearing mandrill of the spring, and the lock housing has a ramp-shaped projection extending from the side wall for holding a second leg of the leg spring.

7. The lock according to claim 1, wherein the stop extends parallel to the bearing mandrill and vertically upwards away from a base of the lock housing.

8. The lock according to claim 7, wherein the spring is a leg spring and the stop, extending parallel to the bearing mandrill, contains a cantilever arm to guide a leg of the leg spring.

* * * * *